US010964286B2

(12) United States Patent
Li et al.

(10) Patent No.: US 10,964,286 B2
(45) Date of Patent: Mar. 30, 2021

(54) VOLTAGE PROVIDING CIRCUIT, GATE DRIVING SIGNAL PROVIDING MODULE, GATE DRIVING SIGNAL COMPENSATION METHOD AND DISPLAY PANEL

(71) Applicants: CHONGQING BOE OPTOELECTRONICS TECHNOLOGY CO., LTD., Chongqing (CN); BOE TECHNOLOGY GROUP CO., LTD., Beijing (CN)

(72) Inventors: Yunsong Li, Beijing (CN); Sijun Lei, Beijing (CN); Xu Lu, Beijing (CN); Liang Gao, Beijing (CN); Xianyong Gao, Beijing (CN); Shuai Hou, Beijing (CN); Yongli Ge, Beijing (CN); Yong Long, Beijing (CN); Ying Zhang, Beijing (CN); Shanbin Chen, Beijing (CN); Peng Zhang, Beijing (CN); Xiangchao Chen, Beijing (CN); Yuxu Geng, Beijing (CN); Fanjian Zeng, Beijing (CN); Zhicai Xu, Beijing (CN)

(73) Assignees: CHONGQING BOE OPTOELECTRONICS TECHNOLOGY CO., LTD., Chonqing (CN); BOE TECHNOLOGY GROUP CO., LTD., Beijing (CN)

( * ) Notice: Subject to any disclaimer, the term of this patent is extended or adjusted under 35 U.S.C. 154(b) by 15 days.

(21) Appl. No.: 16/398,248

(22) Filed: Apr. 29, 2019

(65) Prior Publication Data

US 2020/0098328 A1 Mar. 26, 2020

(30) Foreign Application Priority Data

Sep. 20, 2018 (CN) ..... 201811099532.X

(51) Int. Cl.
*G09G 5/00* (2006.01)
*G09G 3/36* (2006.01)

(52) U.S. Cl.
CPC ..... *G09G 3/3696* (2013.01); *G09G 3/3648* (2013.01); *G09G 2300/0426* (2013.01);
(Continued)

(58) Field of Classification Search
CPC ..... G09G 3/3696; G09G 3/3648; G09G 3/36; G09G 2300/0426; G09G 2310/0289; G09G 2320/041; G09G 2330/021
See application file for complete search history.

(56) References Cited

U.S. PATENT DOCUMENTS 6,469,573 B2 * 10/2002 Kanda ..... G11C 7/062 327/536
6,674,318 B2 * 1/2004 Kanda ..... G11C 7/062 327/540

(Continued)

FOREIGN PATENT DOCUMENTS

CN 101105923 A 1/2008
CN 103247277 A 8/2013
CN 105741811 B 4/2018

OTHER PUBLICATIONS

First Chinese Office Action dated Jun. 30, 2020, for corresponding Chinese Application No. 201811099532.X, 13 pages.

*Primary Examiner* — Vijay Shankar
(74) *Attorney, Agent, or Firm* — Kinney & Lange, P.A.

(57) ABSTRACT

A voltage providing circuit includes a first voltage output end, a temperature-sensitive element, a power supply circuit and an output circuit. The power supply circuit is configured to apply a control voltage signal to a control end of the temperature-sensitive element. The temperature-sensitive element is configured to, under the control of the control voltage signal, generate a temperature-related voltage, and
(Continued)

output the temperature-related voltage via a first end of the temperature-sensitive element, and a value of the temperature-related voltage changes along with an ambient temperature of the temperature-sensitive element. The output circuit is configured to output a temperature-adaptive voltage via the first voltage output end. A difference between a value of the temperature-adaptive voltage and the value of the temperature-related voltage is within a predetermined range.

18 Claims, 5 Drawing Sheets

(52) U.S. Cl.
CPC ..... *G09G 2310/0289* (2013.01); *G09G 2320/041* (2013.01); *G09G 2330/021* (2013.01)

(56) References Cited

U.S. PATENT DOCUMENTS

| | | | | |
|---|---|---|---|---|
| 7,126,419 | B2 * | 10/2006 | Miyasita | H03F 3/45085 330/69 |
| 8,698,548 | B2 * | 4/2014 | Nien | H02M 3/1588 327/513 |
| 8,729,955 | B2 * | 5/2014 | Nien | H03K 3/011 327/513 |
| 2001/0033195 | A1 * | 10/2001 | Kanda | G11C 7/062 327/541 |
| 2007/0216635 | A1 | 9/2007 | Kondoh et al. | |
| 2008/0054987 | A1 | 3/2008 | Choi et al. | |
| 2012/0194258 | A1 * | 8/2012 | Nien | H03K 3/011 327/512 |
| 2013/0241912 | A1 | 9/2013 | Jeong et al. | |
| 2015/0261233 | A1 | 9/2015 | Duan et al. | |
| 2018/0158428 | A1 | 6/2018 | Liu et al. | |

* cited by examiner

VOLTAGE PROVIDING CIRCUIT, GATE DRIVING SIGNAL PROVIDING MODULE, GATE DRIVING SIGNAL COMPENSATION METHOD AND DISPLAY PANEL

CROSS-REFERENCE TO RELATED APPLICATION

The present application claims a priority of the Chinese patent application No. 201811099532.X filed on Sep. 20, 2018, which is incorporated herein by reference in its entirety.

TECHNICAL FIELD

The present disclosure relates to the field of display technology, in particular to a voltage providing circuit, a gate driving signal providing module, a gate driving signal compensation method, and a display panel.

BACKGROUND

For a conventional driving circuit of a display panel, carrier mobility of a Thin Film Transistor (TFT) changes along with an ambient temperature, but an operating voltage applied to the TFT is constant, i.e., the operating voltage does not change along with the ambient temperature. Hence, the carrier mobility of the TFT is relatively low at a low temperature, and it is impossible to turn on the TFT through the constant operating voltage, i.e., a TFT-Liquid Crystal Display (LCD) cannot operate at the low temperature. In addition, the operating voltage required at a normal temperature is larger as compared with a high temperature, so it is impossible for the conventional display panel to reduce the power consumption for a Gate On Array (GOA) circuit when it operates at the high temperature, thereby it is impossible to reduce the power consumption for a logic circuit of the TFT-LCD.

SUMMARY

In one aspect, the present disclosure provides in some embodiments a voltage providing circuit, including a first voltage output end, a temperature-sensitive element, a power supply circuit and an output circuit. The power supply circuit is electrically connected to a control end of the temperature-sensitive element and configured to apply a control voltage signal to the control end of the temperature-sensitive element. The temperature-sensitive element is configured to, under the control of the control voltage signal, generate a temperature-related voltage, and output the temperature-related voltage via a first end of the temperature-sensitive element, and a value of the temperature-related voltage changes along with an ambient temperature of the temperature-sensitive element. The output circuit is electrically connected to the first end of the temperature-sensitive element and the first voltage output end, and configured to generate a temperature-adaptive voltage in accordance with the temperature-related voltage, and output the temperature-adaptive voltage to the first voltage output end. A difference between a value of the temperature-adaptive voltage and the value of the temperature-related voltage is within a predetermined range.

In a possible embodiment of the present disclosure, the voltage providing circuit further includes a voltage conversion circuit including a second voltage output end. The voltage conversion circuit is electrically connected to the first voltage output end, and configured to convert the temperature-adaptive voltage into a temperature-adaptive adjustable voltage, and output the temperature-adaptive adjustable voltage via the second voltage output end.

In a possible embodiment of the present disclosure, the temperature-sensitive element is a transistor, a base of which is the control end of the temperature-sensitive element, a first electrode of which is the first end of the temperature-sensitive element, and a second electrode of which is electrically connected to a first voltage end. The base and the first electrode of the transistor are electrically connected to each other.

In a possible embodiment of the present disclosure, the power supply circuit includes a first control transistor, a control electrode of which is electrically connected to a control node, a first electrode of which is electrically connected to a power source voltage end, and a second electrode of which is electrically connected to the control end of the temperature-sensitive element.

In a possible embodiment of the present disclosure, the output circuit includes a first operational amplifier, a second control transistor and a first control resistor. A positive phase input end of the first operational amplifier is electrically connected to the first end of the temperature-sensitive element, a negative phase input end of the first operational amplifier is electrically connected to the first voltage output end, and an output end of the first operational amplifier is electrically connected to the control node. A control electrode of the second control transistor is electrically connected to the control node, a first electrode of the second control transistor is electrically connected to the power source voltage end, and a second electrode of the second control transistor is electrically connected to the negative phase input end of the first operational amplifier. A first end of the first control resistor is electrically connected to the second electrode of the second control transistor, and a second end of the first control resistor is electrically connected to the first voltage end.

In a possible embodiment of the present disclosure, the voltage conversion circuit includes a third control transistor and a second control resistor. A control electrode of the third control transistor is electrically connected to the control node, a first electrode of the third control transistor is electrically connected to the power source voltage end, and a second electrode of the third control transistor is electrically connected to the second voltage output end. A first end of the second control resistor is electrically connected to the second voltage output end, and a second end of the second control resistor is electrically connected to the first voltage end.

In another aspect, the present disclosure provides in some embodiments a gate driving signal providing module including the above-mentioned voltage providing circuit, a reference voltage generation circuit and a gate driving signal generation circuit. The reference voltage generation circuit is electrically connected to the first voltage output end of the voltage providing circuit, and configured to generate a first reference voltage in accordance with a standard voltage and the temperature-adaptive voltage from the first voltage output end, and output the first reference voltage via a reference voltage output end. A first input end of the gate driving signal generation circuit is electrically connected to the reference voltage output end, and a second input end of the gate driving signal generation circuit is configured to receive a second reference voltage. The gate driving signal generation circuit is configured to generate a gate driving signal in accordance with the first reference voltage and the second reference voltage, and output the gate driving signal via the gate driving signal output end.

In a possible embodiment of the present disclosure, the voltage providing circuit further includes a voltage conversion circuit including a second voltage output end. The voltage conversion circuit is electrically connected to the first voltage output end, and configured to convert the temperature-adaptive voltage into a corresponding temperature-adaptive adjustable voltage, and output the temperature-adaptive adjustable voltage via the second voltage output end. The reference voltage generation circuit is electrically connected to the second voltage output end, and further configured to perform a weighted summation operation on the temperature-adaptive adjustable voltage and the standard voltage to generate the first reference voltage, and output the first reference voltage via the reference voltage output end.

In a possible embodiment of the present disclosure, the reference voltage generation circuit includes a first input resistor, a second input resistor, a third input resistor, a feedback resistor, and a second operational amplifier as an adder amplifier. A first end of the first input resistor is electrically connected to a positive phase input end of the second operational amplifier, and a second end of the first input resistor is configured to receive the standard voltage. A first end of the second input resistor is electrically connected to the positive phase input end of the second operational amplifier, and a second end of the second input resistor is configured to receive the temperature-adaptive adjustable voltage. A first end of the third input resistor is electrically connected to a negative phase input end of the second operational amplifier, and a second end of the third input resistor is electrically connected to the second voltage end. A first end of the feedback resistor is electrically connected to the negative phase input end of the second operational amplifier, a second end of the feedback resistor is electrically connected to an output end of the second operational amplifier, and the second operational amplifier is configured to output the first reference voltage via the output end.

In a possible embodiment of the present disclosure, the gate driving signal providing module further includes a booster circuit through which the first input end of the gate driving signal generation circuit is connected to the reference voltage output end. The booster circuit is configured to boost the first reference voltage to acquire a first boosted reference voltage, and apply the first boosted reference voltage to the first input end of the gate driving signal generation circuit. The gate driving signal generation circuit is further configured to generate the gate driving signal in accordance with the first boosted reference voltage and the second reference voltage.

In a possible embodiment of the present disclosure, the gate driving signal generation circuit is a level shifter.

In a possible embodiment of the present disclosure, the booster circuit is a charge pump.

In yet another aspect, the present disclosure provides in some embodiments a gate driving signal compensation method for use in a display panel and for compensating a gate driving signal through the above-mentioned gate driving signal providing module, including: generating, by a reference voltage generation circuit, a first reference voltage related to an ambient temperature of the display panel in accordance with a standard voltage and a temperature-adaptive voltage from a voltage providing circuit, the first reference voltage decreasing along with an increase in the ambient temperature and increasing along with a decrease in the ambient temperature; and generating, by the gate driving signal generation circuit, the gate driving signal in accordance with the first reference voltage and a second reference voltage.

In a possible embodiment of the present disclosure, the first reference voltage is a high voltage, and the second reference voltage is a low voltage.

In still yet another aspect, the present disclosure provides in some embodiments a display panel including the above-mentioned gate driving signal providing module.

DETAILED DESCRIPTION OF EMBODIMENTS

In order to make objects, technical solutions and advantages of the present disclosure more apparent, the present disclosure will be described hereinafter in a clear and complete manner in conjunction with the drawings and embodiments. Obviously, the following embodiments merely relate to a part of, rather than all of, the embodiments of the present disclosure, and based on these embodiments, a person skilled in the art may, without any creative effort, obtain the other embodiments, which also fall within the scope of the present disclosure.

All transistors adopted in the embodiments of the present disclosure may be triodes, TFTs, field effect transistors (FETs) or any other elements having an identical feature. In order to differentiate two electrodes other than a control electrode from each other, one of the two electrodes may be called as a first electrode, and the other may be called as a second electrode.

In actual use, when the transistor is a triode, the control electrode may be a base, the first electrode may be a collector and the second electrode may be an emitter; or the control electrode may be a base, the first electrode may be an emitter and the second electrode may be a collector.

In actual use, when the transistor is a TFT or FET, the control electrode may be a gate electrode, the first electrode may be a drain electrode and the second electrode may be a source electrode; or the control electrode may be a gate electrode, the first electrode may be a source electrode and the second electrode may be a drain electrode.

Figure 1:
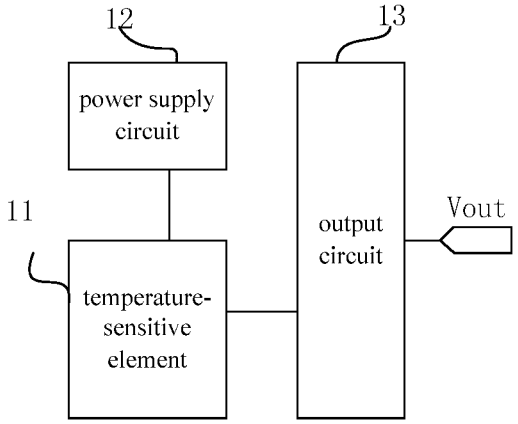
FIG. 1 is a schematic view showing a voltage providing circuit according to one embodiment of the present disclosure.

The present disclosure provides in some embodiments a voltage providing circuit which, as shown in FIG. 1, includes a first voltage output end Vout, a temperature-sensitive element 11, a power supply circuit 12 and an output circuit 13. The power supply circuit 12 is electrically connected to a control end of the temperature-sensitive element 11 and configured to apply a control voltage signal to the control end of the temperature-sensitive element 11. The temperature-sensitive element 11 is configured to, under the control of the control voltage signal, generate a temperature-related voltage, and output the temperature-related voltage via a first end of the temperature-sensitive element 11, and a value of the temperature-related voltage changes along with an ambient temperature of the temperature-sensitive element 11. The output circuit 12 is electrically connected to the first end of the temperature-sensitive element 11 and the first voltage output end Vout, and configured to generate a temperature-adaptive voltage in accordance with the temperature-related voltage, and output the temperature-adaptive voltage to the first voltage output end Vout. A difference between a value of the temperature-adaptive voltage and the value of the temperature-related voltage is within a predetermined range.

Generally, carrier mobility of a TFT decreases at a low temperature and increases at a high temperature. However, in the related art, an operating voltage of the TFT is a constant, and it is difficult for the constant operating voltage to meet the high-voltage driving requirement at the low temperature, so a TFT-LCD cannot operate at the low temperature. In addition, at the high temperature, it is unnecessary to drive the TFT-LCD through a high voltage, so the power consumption for a GOA circuit is relatively large.

According to the voltage providing circuit in the embodiments of the present disclosure, the temperature-sensitive element may generate the temperature-related voltage under the control of the control voltage signal from the power supply circuit, and the output circuit may generate the temperature-adaptive voltage in accordance with the temperature-related voltage. The value of the temperature-related voltage and the value of the temperature-adaptive voltage may change along with the ambient temperature. The temperature-adaptive voltage may be applied to the GOA circuit, so as to enable the GOA circuit to generate a driving signal changing along with the temperature. As a result, it is able to prevent the TFT from being out of work at the low temperature, and reduce the power consumption for the display panel at the high temperature.

During the implementation, the ambient temperature may be an ambient temperature of the temperature-sensitive element, i.e., an ambient temperature of a display panel to which the voltage providing circuit is applied.

In actual use, the value of the temperature-related voltage may decrease along with an increase in the ambient temperature, and increase along with a decrease in the ambient temperature. In addition, the difference between the value of the temperature-adaptive voltage and the value of the temperature-related voltage may be controlled by the output circuit within the predetermined range, so that the value of the temperature-adaptive voltage may be approximately equal to the value of the temperature-related voltage. Hence, the value of the temperature-adaptive voltage may decrease along with an increase in the ambient temperature and increase along with a decrease in the ambient temperature, i.e., each of the temperature-related voltage and the temperature-adaptive voltage may have a negative temperature coefficient.

To be specific, the predetermined range may be, but not limited to, greater than or equal to −0.05V and smaller than or equal to 0.05V. Of course, the predetermined range may be set in accordance with the practical need, as long as the temperature-adaptive voltage may be approximately equal to the temperature-related voltage.

During the implementation, the voltage providing circuit may further include a voltage conversion circuit including a second voltage output end. The voltage conversion circuit may be electrically connected to the first voltage output end, and configured to convert the temperature-adaptive voltage into a corresponding temperature-adaptive adjustable voltage, and output the temperature-adaptive adjustable voltage via the second voltage output end.

In the embodiments of the present disclosure, the voltage conversion circuit is used to convert the temperature-adaptive voltage, it is able to amplify or reduce the temperature-adaptive voltage, thereby to generate and output the temperature-adaptive adjustable voltage that meets a circuit operating specification.

To be specific, the temperature-sensitive element may be a transistor, a base of which is the control end of the temperature-sensitive element, a first electrode of which is the first end of the temperature-sensitive element, and a second electrode of which is electrically connected to a first voltage end. The base and the first electrode of the transistor may be electrically connected to each other.

During the implementation, the first voltage end may be, but not limited to, a low voltage end or a ground end.

In the embodiments of the present disclosure, the transistor may be selected as the temperature-sensitive element. A temperature-adaptive circuit scheme is designed on the basis of a negative temperature characteristic of a base-to-emitter voltage of the transistor when the transistor is turned on in a saturation state.

When the transistor is turned on in the saturation state, the base-to-emitter voltage Vbe of the transistor may increase along with a decrease in the ambient temperature, and decrease along with an increase in the ambient temperature. The base-to-emitter voltage Vbe of the transistor refers to a voltage between a base and an emitter of the transistor.

Although the transistor is taken as an example hereinabove, the temperature-sensitive element may not be limited thereto. During the implementation, the temperature-sensitive element may also be any other element capable of generating the temperature-related voltage.

During the implementation, the power supply circuit may include a first control transistor, a control electrode of which is electrically connected to a control node, a first electrode of which is electrically connected to a power source voltage end, and a second electrode of which is electrically connected to the control end of the temperature-sensitive element.

During the implementation, the output circuit may include a first operational amplifier, a second control transistor and a first control resistor. A positive phase input end of the first operational amplifier may be electrically connected to the first end of the temperature-sensitive element, a negative phase input end of the first operational amplifier may be electrically connected to the first voltage output end, and an output end of the first operational amplifier may be electrically connected to the control node. A control electrode of the second control transistor may be electrically connected to the control node, a first electrode of the second control transistor may be electrically connected to the power source voltage end, and a second electrode of the second control transistor may be electrically connected to the negative phase input end of the first operational amplifier. A first end of the first control resistor may be electrically connected to the second electrode of the second control transistor, and a second end of the first control resistor may be electrically connected to the first voltage end.

To be specific, the voltage conversion circuit may include a third control transistor and a second control resistor. A control electrode of the third control transistor may be electrically connected to the control node, a first electrode of the third control transistor may be electrically connected to the power source voltage end, and a second electrode of the third control transistor may be electrically connected to the second voltage output end. A first end of the second control resistor may be electrically connected to the second voltage output end, and a second end of the second control resistor may be electrically connected to the first voltage end.

The voltage providing circuit will be described hereinafter in more details in conjunction with two embodiments.

Figure 2:
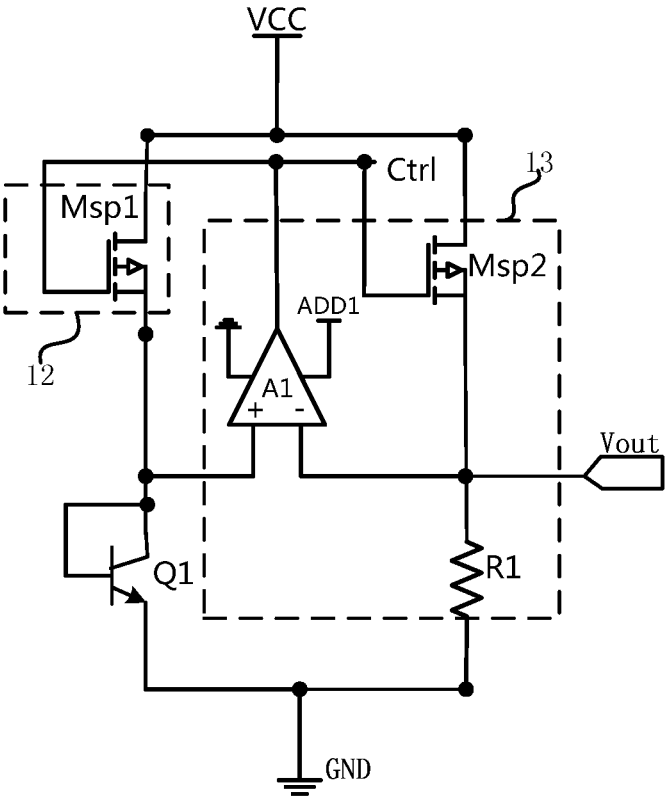
FIG. 2 is a circuit diagram of the voltage providing circuit according to at least one embodiment of the present disclosure.

As shown in FIG. 2, in a first embodiment of the present disclosure, the voltage providing circuit may include a first voltage output end Vout, a triode Q1, a power supply circuit 12 and an output circuit 13. A base of Q1 may be electrically connected to a collector of Q1, and an emitter of Q1 may be electrically connected to a ground end GND. The power supply circuit 12 may include a first control transistor Msp1, a gate electrode of which is electrically connected to a control node Ctrl, a drain electrode of which is electrically connected to a power source voltage end, and a source electrode of which is electrically connected to the base of Q1. The power source voltage end is configured to output a power source voltage VCC. The output circuit 13 may include a first operational amplifier A1, a second control transistor Msp2 and a first control resistor R1. A positive phase input end of A1 may be electrically connected to the collector of Q1, a negative phase input end of A1 may be electrically connected to the first voltage output end Vout, and an output end of A1 may be electrically connected to the control node Ctrl. There may exist a virtual short-circuit connection between the positive phase input end and the negative phase input end of A1. A gate electrode of Msp2 may be electrically connected to the control node Ctrl, a drain electrode of Msp2 may be electrically connected to the power source voltage end, and a source electrode of Msp2 may be electrically connected to the first voltage output end Vout. A first end of R1 may be electrically connected to the first voltage output end Vout, and a second end of R1 may be electrically connected to the ground end GND.

In FIG. 2, ADD1 represents a first voltage, i.e., an operating voltage applied to A1.

In FIG. 2, the base of Q1 may be the control end of the temperature-sensitive element, the collector of Q1 may be the first end of the temperature-sensitive element, and the emitter of Q1 may be the second end of the temperature-sensitive element. Q1 may be an NPN-type transistor, and Msp1 and Msp2 may be both N-channel Metal-Oxide-Semiconductor (NMOS) FETs. However, the types of Q1, Msp1 and Msp2 will not be particularly defined herein.

During the operation of the voltage providing circuit in FIG. 2, Msp1 may be turned on under the control of Ctrl, VCC is inputted into the base of Q1 to turn on Q1 in a saturation state, thereby to enable the base-to-emitter voltage Vbe of Q1 to have a negative temperature coefficient and enable a voltage at the emitter of Q1 to be 0. At this time, a voltage at the base of Q1 may decrease along with an increase in the ambient temperature of Q1, and increase along with a decrease in the ambient temperature of Q1. In addition, because the collector of Q1 is electrically connected to the base of Q1, a voltage at the collector of Q1 (i.e., the temperature-related voltage which, as shown in FIG. 2, is equal to the base-to-emitter voltage Vbe of Q1) may increase along with a decrease in the ambient temperature of Q1, and decrease along with an increase in the ambient temperature of Q1.

Msp2 may be turned on under the control of Ctrl. A current flowing from the drain electrode of Msp2 to the source electrode of Msp2 may be a first current I1, and at this time, a voltage at the negative phase input end of A1 (i.e., the temperature-adaptive voltage outputted from Vout) may be I1*Rz1. When I1*Rz1 is not equal to the temperature-related voltage, A1 may output a corresponding current adjustment control signal to the gate electrode of Msp2, so as to change I1 until I1*Rz1 is equal to the temperature-related voltage, thereby to output the temperature-adaptive voltage via Vout. In this embodiment, a value of the temperature-adaptive voltage is equal to Vbe, and Rz1 represents a resistance of R1.

During the operation of the voltage providing circuit in FIG. 2, A1 may be in a deep negative-feedback state, so A1 may accurately sense the voltage at the collector of Q1 and the voltage at the first end of R1. When the voltage at the collector of Q1 is not equal to the voltage at the first end of R1, the voltage at the gate electrode of Msp1 and the voltage at the gate electrode of Msp2 may be adjusted, until the voltage t the collector of Q1 is equal to the voltage at the first end of R1.

During the implementation, Vbe=(kT/q)In(Ic/Is), where T represents the ambient temperature, k represents a Boltzmann's constant, q represents the quantity of electronic charges, Ic represents a current flowing from the collector of Q1 to the emitter of Q1 and Is represents a saturation current and it is associated with an area of the emitter of Q1.

When the voltage at the gate electrode of Msp2 changes, Ic and thereby Vbe may change too. However, Vbe is still associated with the ambient temperature T.

Figure 3:
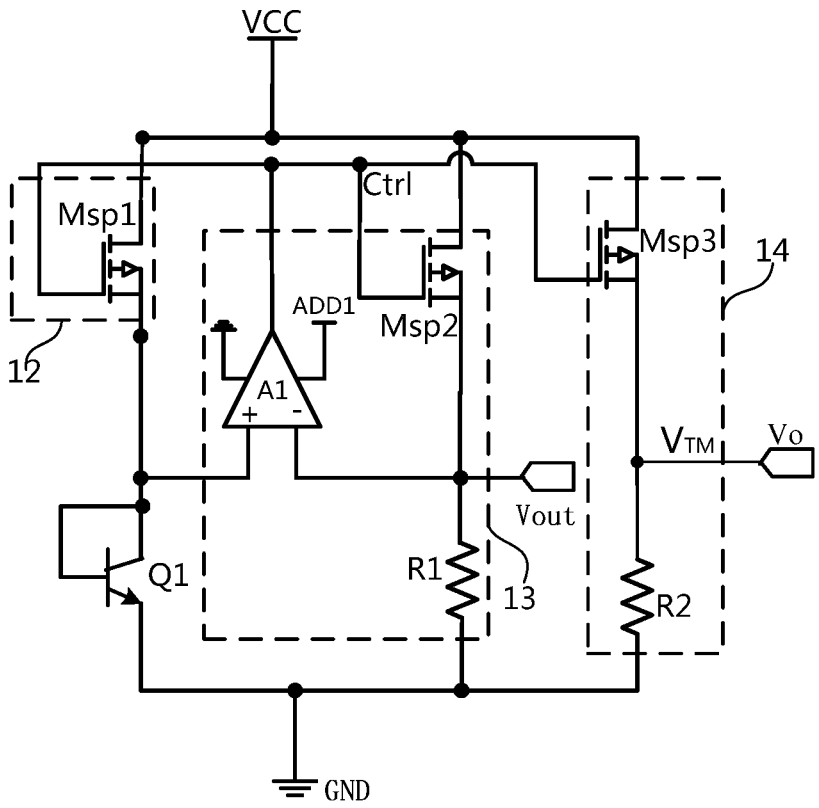
FIG. 3 is another circuit diagram of the voltage providing circuit according to at least one embodiment of the present disclosure.

As shown in FIG. 3, in a second embodiment of the present disclosure, the voltage providing circuit may include a first voltage output end Vout, a transistor Q1, a power supply circuit 12, an output circuit 13 and a voltage conversion circuit 14. A base of Q1 may be electrically connected to a collector of Q1, and an emitter of Q1 may be electrically connected to a ground end GND. The power supply circuit 12 may include a first control transistor Msp1, a gate electrode of which is electrically connected to a control node Ctrl, a drain electrode of which is electrically connected to a power source voltage end, and a source electrode of which is electrically connected to the base of Q1. The power source voltage end is configured to input a power source voltage VCC. The output circuit 13 may include a first operational amplifier A1, a second control transistor Msp2 and a first control resistor R1. A positive phase input end of A1 may be electrically connected to the collector of Q1, a negative phase input end of A1 may be electrically connected to the first voltage output end Vout, and an output end of A1 may be electrically connected to the control node Ctrl. There may exist a virtual short-circuit connection between the positive phase input end and the negative phase input end of A1. A gate electrode of Msp2 may be electrically connected to the control node Ctrl, a drain electrode of Msp2 may be electrically connected to the power source voltage end, and a source electrode of Msp2 may be electrically connected to the first voltage output end Vout. A first end of R1 may be electrically connected to the first voltage output end Vout, and a second end of R1 may be electrically connected to the ground end GND. The voltage conversion circuit 14 may include a third control transistor Msp3 and a second control resistor R2. A gate electrode of Msp3 may be electrically connected to the control node Ctrl, a drain electrode of Msp3 may be electrically connected to the power source voltage end, and a source electrode of Msp3 may be electrically connected to a second voltage output end Vo. A first end of R2 may be electrically connected to the second voltage output end Vo, and a second end of R2 may be electrically connected to the ground end GND. The voltage conversion circuit 14 is configured to output a temperature-adaptive adjustable voltage $V_{TM}$ via the second voltage output end Vo.

In FIG. 3, the base of Q1 may be the control end of the temperature-sensitive element, the collector of Q1 may be the first end of the temperature-sensitive element, and the emitter of Q1 may be the second end of the temperature-sensitive element. Q1 may be an NPN-type transistor, and Msp1, Msp2 and Msp3 may be all NMOS FETs. However, the types of Q1, Msp1, Msp2 and Msp3 will not be particularly defined herein.

In FIG. 3, Msp2, R1, Msp3 and R2 may together form a current mirror.

During the operation of the voltage providing circuit in FIG. 3, Msp1 may be turned on under the control of Ctrl, so as to output VCC to the base of Q1 and turn on Q1 in a saturation state, thereby to enable the base-to-emitter voltage Vbe of Q1 to have a negative temperature coefficient and enable a voltage at the emitter of Q1 to be 0. At this time, a voltage at the base of Q1 may decrease along with an increase in the ambient temperature of Q1, and increase along with a decrease in the ambient temperature of Q1. In addition, because the collector of Q1 is electrically connected to the base of Q1, the temperature-related voltage (which, as shown in FIG. 2, is equal to the base-to-emitter voltage Vbe of Q1) may increase along with a decrease in the ambient temperature of Q1, and decrease along with an increase in the ambient temperature of Q1.

Msp2 may be turned on under the control of Ctrl. A current flowing from the drain electrode of Msp2 to the source electrode of Msp2 may be a first current I1, and at this time, a voltage at the negative phase input end of A1 (i.e., the temperature-adaptive voltage outputted from Vout) may be I1*Rz1. When I1*Rz1 is not equal to the temperature-related voltage, A1 may output a corresponding current adjustment control signal to the gate electrode of Msp2, so as to change I1 until I1*Rz1 is equal to the temperature-related voltage, thereby to output the temperature-adaptive voltage via Vout. In this embodiment, a value of the temperature-adaptive voltage is equal to Vbe, and Rz1 represents a resistance of R1.

In addition, because Msp2, R1, Msp3 and R2 together form a current mirror, a second current I2 flowing from the drain electrode of Msp3 to the source electrode of Msp3 may be equal to K*I1, where K represents a ratio of a width-to-length ratio of a channel of Msp3 to a width-to-length ratio of a channel of Msp2. At this time, $V_{TM}$=(K*Vbe*Rz2)/Rz1, where Rz2 represents a resistance of R2. Vbe is a voltage negatively relevant to the ambient temperature, so $V_{TM}$ may also be negatively relevant to the ambient temperature.

During the operation of the voltage providing circuit in FIG. 3, A1 may be in a deep negative-feedback state, so A1 may accurately sense the voltage at the collector of Q1 and the voltage at the first end of R1. When the voltage at the collector of Q1 is not equal to the voltage at the first end of R1, the voltage at the gate electrode of Msp1 and the voltage at the gate electrode of Msp2 may be adjusted, until the voltage at the collector of Q1 is equal to the voltage at the first end of R1.

The present disclosure further provides in some embodiments a gate driving signal providing module which includes the above-mentioned voltage providing circuit, a reference voltage generation circuit and a gate driving signal generation circuit. The reference voltage generation circuit is electrically connected to the first voltage output end of the voltage providing circuit, and configured to generate a first reference voltage in accordance with a standard voltage and the temperature-adaptive voltage from the first voltage output end, and output the first reference voltage via a reference voltage output end. A first input end of the gate driving signal generation circuit is electrically connected to the reference voltage output end, and a second input end of the gate driving signal generation circuit is configured to receive a second reference voltage. The gate driving signal generation circuit is configured to generate a gate driving signal in accordance with the first reference voltage and the second reference voltage, and output the gate driving signal via the gate driving signal output end.

According to the gate driving signal providing module in the embodiments of the present disclosure, the reference voltage generation circuit may generate the first reference voltage in accordance with the temperature-adaptive voltage, and then the gate driving signal generation circuit may generate the gate driving signal in accordance with the first reference voltage.

To be specific, the gate driving signal generation circuit may generate the gate driving signal in accordance with the first reference voltage and the second reference voltage as follows. The gate driving signal may be set in accordance with a predetermined duty ratio and a predetermined period, and this gate driving signal may be a clock signal. When the gate driving signal is at a high level, a voltage of the gate driving signal may be set as the first reference voltage, and when the gate driving signal is at a low level, the voltage of the gate driving signal may be set as the second reference voltage.

Figure 4:
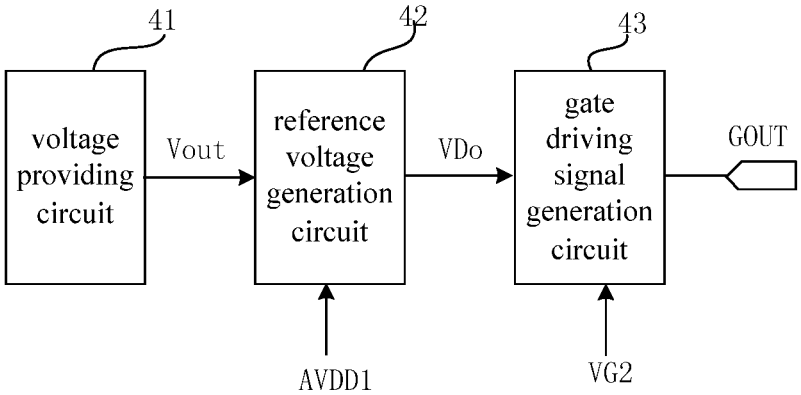
FIG. 4 is a schematic view showing a gate driving signal providing module according to one embodiment of the present disclosure.

As shown in FIG. 4, the gate driving signal providing module may include a voltage providing circuit 41, a reference voltage generation circuit 42 and a gate driving signal generation circuit 43.

The reference voltage generation circuit 42 may be electrically connected to the first voltage output end Vout of the voltage providing circuit 41, and configured to generate the first reference voltage in accordance with a standard voltage AVDD1 and the temperature-adaptive voltage from the first voltage output end Vout, and output the first reference voltage via a reference voltage output end VDo. A first input end of the gate driving signal generation circuit 43 may be electrically connected to the reference voltage output end VDo, and a second input end of the gate driving signal generation circuit 43 may be configured to receive a second reference voltage VG2. The gate driving signal generation circuit 43 is configured to generate a gate driving signal in accordance with the first reference voltage and the second reference voltage VG2, and output the gate driving signal via a gate driving signal output end GOUT.

According to the gate driving signal providing module in the embodiments of the present disclosure, the reference voltage generation circuit 42 may generate the first reference voltage in accordance with the temperature-adaptive voltage in such a manner that the first reference voltage is related to the ambient temperature. As a result, the gate driving signal generated by the gate driving signal generation circuit 43 may also be related to the ambient temperature.

To be specific, the voltage providing circuit may further include a voltage conversion circuit including a second voltage output end. The voltage conversion circuit is configured to convert the temperature-adaptive voltage into a corresponding temperature-adaptive adjustable voltage, and output the temperature-adaptive adjustable voltage via the second voltage output end. The reference voltage generation circuit may be electrically connected to the second voltage output end, and further configured to perform a weighted summation operation on the temperature-adaptive adjustable voltage and the standard voltage to generate the first reference voltage, and output the first reference voltage via the reference voltage output end.

During the implementation, the reference voltage generation circuit may include a first input resistor, a second input resistor, a third input resistor, a feedback resistor, and a second operational amplifier as an adder amplifier. A first end of the first input resistor may be electrically connected to a positive phase input end of the second operational amplifier, and a second end of the first input resistor may be configured to receive the standard voltage. A first end of the second input resistor may be electrically connected to the positive phase input end of the second operational amplifier, and a second end of the second input resistor may be configured to receive the temperature-adaptive adjustable voltage. A first end of the third input resistor may be electrically connected to a negative phase input end of the second operational amplifier, and a second end of the third input resistor may be electrically connected to the second voltage end. A first end of the feedback resistor may be electrically connected to the negative phase input end of the second operational amplifier, a second end of the feedback resistor may be electrically connected to an output end of the second operational amplifier, and the second operational amplifier is configured to output the first reference voltage via the output end thereof.

In actual use, the second voltage end may be, but not limited to, a low voltage end or a ground end.

Figure 5:
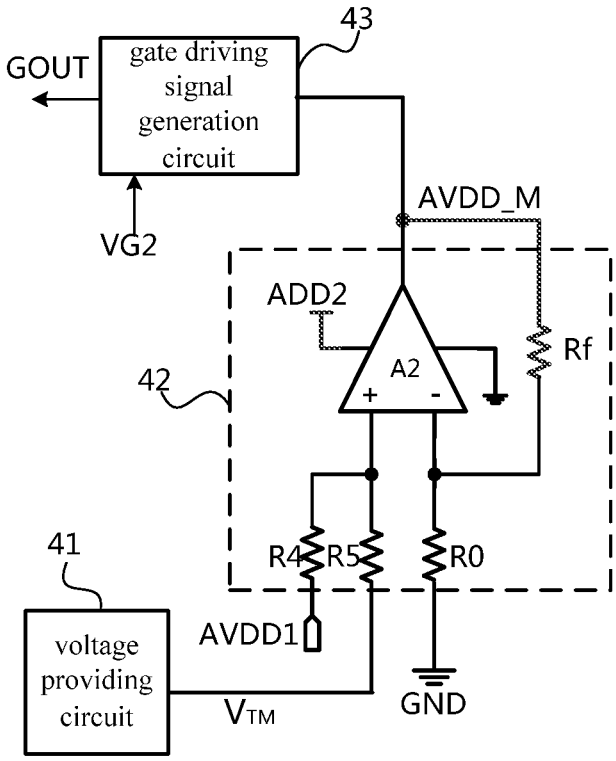
FIG. 5 is a circuit diagram of the gate driving signal providing module according to at least one embodiment of the present disclosure.

As shown in FIG. 5, in a first embodiment of the present disclosure, the gate driving signal providing module may include a voltage providing circuit 41, a reference voltage generation circuit 42 and a gate driving signal generation circuit 43. The voltage providing circuit 41 is configured to output the temperature-adaptive adjustable voltage $V_{TM}$. The reference voltage generation circuit 42 may include a first input resistor R4, a second input resistor R5, a third input resistor R0, a feedback resistor Rf, and a second operational amplifier A2 as an adder amplifier. A first end of the first input resistor R4 may be electrically connected to a positive phase input end of the second operational amplifier A2, and a second end of the first input resistor R4 may be configured to receive the standard voltage AVDD1. A first end of the second input resistor R5 may be electrically connected to the positive phase input end of the second operational amplifier A2, and a second end of the second input resistor R5 may be configured to receive the temperature-adaptive adjustable voltage $V_{TM}$. A first end of the third input resistor R0 may be electrically connected to a negative phase input end of the second operational amplifier A2, and a second end of the third input resistor R0 may be electrically connected to the ground end GND. A first end of the feedback resistor Rf may be electrically connected to the negative phase input end of the second operational amplifier A2, a second end of the feedback resistor Rf may be electrically connected to an output end of the second operational amplifier A2, and the second operational amplifier A2 is configured to output a first reference voltage AVDD_M via the output end thereof. A first input end of the gate driving signal generation circuit 43 may be configured to receive the first reference voltage AVDD_M, and a second input end of the gate driving signal generation circuit 43 may be configured to receive a second reference voltage VG2. The gate driving signal generation circuit 43 is configured to generate a gate driving signal in accordance with the first reference voltage AVDD_M and the second reference voltage VG2, and output the gate driving signal via the gate driving signal output end GOUT.

In FIG. 5, ADD2 may be a second voltage, i.e., an operating voltage applied to A2.

During the operation of the gate driving signal providing module, the second operational amplifier A2, as the adder amplifier, may perform a summation operation on $V_{TM}$ and AVDD1 so as to acquire AVDD_M, and then the gate driving signal generation circuit 43 may generate the gate driving signal in accordance with AVDD_M and VG2. AVDD_M=AVDD1*Rfz/R4$z$+$V_{TM}$*Rfz/R5$z$, where Rfz represents a resistance of Rf, R4$z$ represents a resistance of R4, and R5$z$ represents a resistance of R5. $V_{TM}$ is related to the ambient temperature, so AVDD_M and the gate driving signal acquired in accordance with AVDD_M may also be related to the ambient temperature.

In actual use, the gate driving signal generation circuit 43 may be a level shifter.

During the implementation, the gate driving signal providing module may further include a booster circuit through which the first input end of the gate driving signal generation circuit is connected to the reference voltage output end. The booster circuit is configured to boost the first reference voltage to acquire a first boosted reference voltage, and transmit the first boosted reference voltage to the first input end of the gate driving signal generation circuit. The gate driving signal generation circuit is further configured to generate the gate driving signal in accordance with the first boosted reference voltage and the second reference voltage.

In actual use, the booster circuit may be a charge pump.

Figure 6:
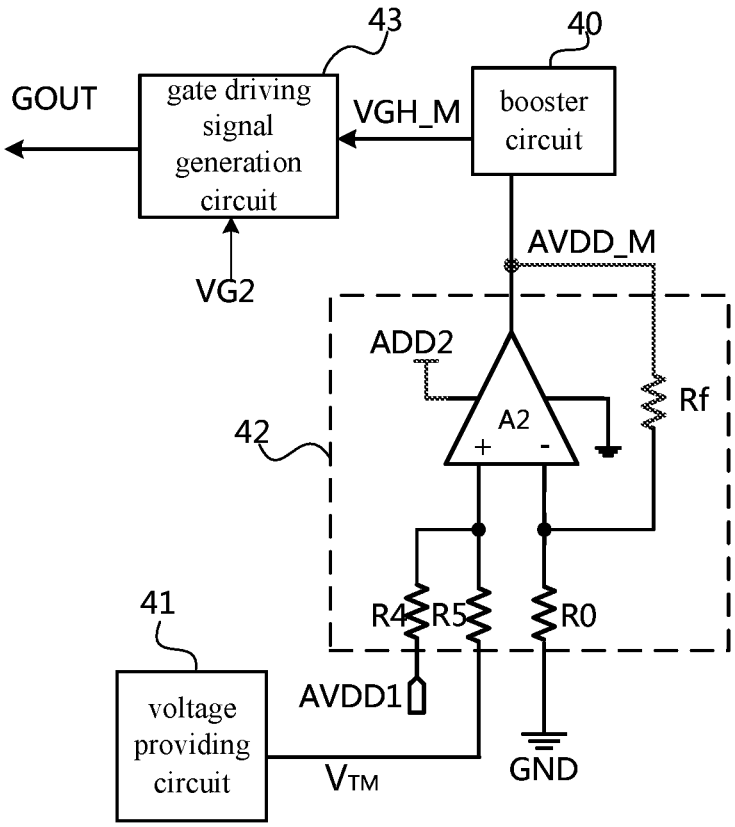
FIG. 6 is another circuit diagram of the gate driving signal providing module according to at least one embodiment of the present disclosure.

As shown in FIG. 6, in a second embodiment of the present disclosure, the gate driving signal providing module may include a voltage providing circuit 41, a reference voltage generation circuit 42, a booster circuit 40 and a gate driving signal generation circuit 43. The voltage providing circuit 41 is configured to output the temperature-adaptive adjustable voltage $V_{TM}$. The reference voltage generation circuit 42 may include a first input resistor R4, a second input resistor R5, a third input resistor R0, a feedback resistor Rf, and a second operational amplifier A2 as an adder amplifier. A first end of the first input resistor R4 may be electrically connected to a positive phase input end of the second operational amplifier A2, and a second end of the first input resistor R4 may be configured to receive the standard voltage AVDD1. A first end of the second input resistor R5 may be electrically connected to the positive phase input end of the second operational amplifier A2, and a second end of the second input resistor R5 may be configured to receive the temperature-adaptive adjustable voltage $V_{TM}$. A first end of the third input resistor R0 may be electrically connected to a negative phase input end of the second operational amplifier A2, and a second end of the third input resistor R0 may be electrically connected to the ground end GND. A first end of the feedback resistor Rf may be electrically connected to the negative phase input end of the second operational amplifier A2, a second end of the feedback resistor Rf may be electrically connected to an output end of the second operational amplifier A2, and the second operational amplifier A2 is configured to output a first reference voltage AVDD_M via the output end thereof. The booster circuit 40 is configured to boost the first reference voltage AVDD_M to acquire a first boosted reference voltage VGH_M, and transmit the first boosted reference voltage VGH_M to a first input end of the gate driving signal generation circuit 43. The first input end of the gate driving signal generation circuit 43 may be configured to receive the first boosted reference voltage VGH_M, and a second input end of the gate driving signal generation circuit 43 may be configured to receive a second reference voltage VG2. The gate driving signal generation circuit 43 is configured to generate the gate driving signal in accordance with the first boosted reference voltage VGH_M and the second reference voltage VG2.

During the operation of the gate driving signal providing module, the second operational amplifier A2, as the adder amplifier, may perform a summation operation on $V_{TM}$ and AVDD1 so as to acquire AVDD_M, the booster circuit 40 may boost AVDD_M to acquire VGH_M, and then the gate driving signal generation circuit 43 may generate the gate driving signal in accordance with VGH_M and VG2. AVDD_M=AVDD1*Rfz/R4z+$V_{TM}$*Rfz/R5z, where Rfz represents a resistance of Rf, R4z represents a resistance of R4, and R5z represents a resistance of R5. $V_{TM}$ is related to the ambient temperature, so VGH_M and the gate driving signal may also be related to the ambient temperature.

In actual use, the gate driving signal generation circuit 43 may be a level shifter.

Figure 7:
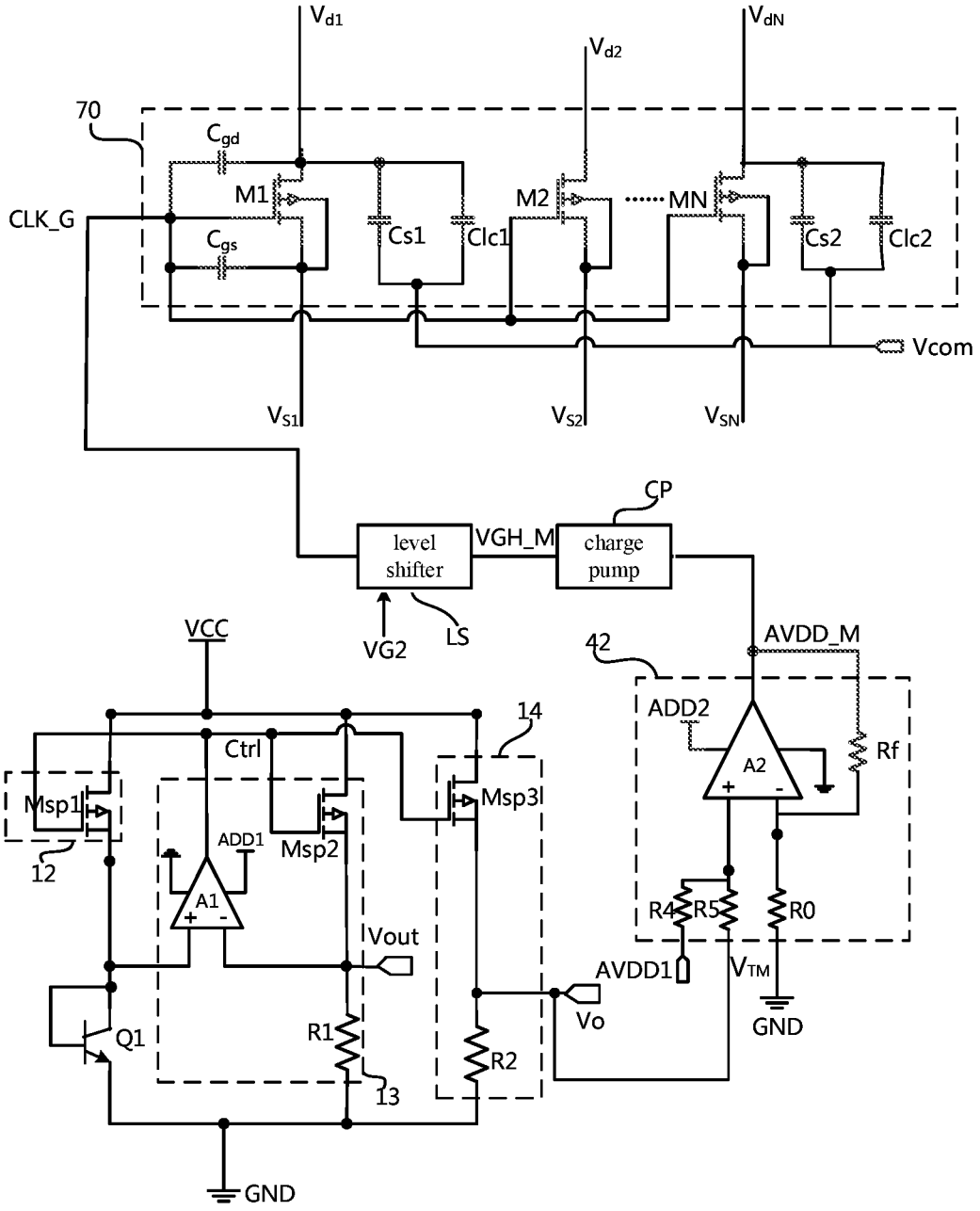
FIG. 7 is yet another circuit diagram of the gate driving signal providing module according to at least one embodiment of the present disclosure.

As shown in FIG. 7, in a third embodiment of the present disclosure, the gate driving signal providing module may include a voltage providing circuit, a reference voltage generation circuit 42, a charge pump CP and a level shifter LS. The voltage providing circuit may include a first voltage output end Vout, a transistor Q1, a power supply circuit 12, an output circuit 13 and a voltage conversion circuit 14. A base of Q1 may be electrically connected to a collector of Q1, and an emitter of Q1 may be electrically connected to a ground end GND. The power supply circuit 12 may include a first control transistor Msp1, a gate electrode of which is electrically connected to a control node Ctrl, a drain electrode of which is electrically connected to a power source voltage end, and a source electrode of which is electrically connected to the base of Q1. The power source voltage end is configured to input a power source voltage VCC. The output circuit 13 may include a first operational amplifier A1, a second control transistor Msp2 and a first control resistor R1. A positive phase input end of A1 may be electrically connected to the collector of Q1, a negative phase input end of A1 may be electrically connected to the first voltage output end Vout, and an output end of A1 may be electrically connected to the control node Ctrl. There may exist a virtual short-circuit connection between the positive phase input end and the negative phase input end of A1. A gate electrode of Msp2 may be electrically connected to the control node Ctrl, a drain electrode of Msp2 may be electrically connected to the power source voltage end, and a source electrode of Msp2 may be electrically connected to the first voltage output end Vout. A first end of R1 may be electrically connected to the first voltage output end Vout, and a second end of R2 may be electrically connected to the ground end GND. The voltage conversion circuit 14 may include a second voltage output end Vo, a third control transistor Msp3 and a second control resistor R2. A gate electrode of Msp3 may be electrically connected to the control node Ctrl, a drain electrode of Msp3 may be electrically connected to the power source voltage end, and a source electrode of Msp3 may be electrically connected to the second voltage output end Vo. A first end of R2 may be electrically connected to the second voltage output end Vo, and a second end of R2 may be electrically connected to the ground end GND. The voltage conversion circuit 14 is configured to output the temperature-adaptive adjustable voltage $V_{TM}$ via the second voltage output end Vo. The reference voltage generation circuit 42 may include a first input resistor R4, a second input resistor R5, a third input resistor R0, a feedback resistor Rf, and a second operational amplifier A2 as an adder amplifier. A first end of the first input resistor R4 may be electrically connected to a positive phase input end of the second operational amplifier A2, and a second end of the first input resistor R4 may be configured to receive a standard voltage AVDD1. A first end of the second input resistor R5 may be electrically connected to the positive phase input end of the second operational amplifier A2, and a second end of the second input resistor R5 may be configured to receive the temperature-adaptive adjustable voltage $V_{TM}$. A first end of the third input resistor R0 may be electrically connected to a negative phase input end of the second operational amplifier A2, and a second end of the third input resistor R0 may be electrically connected to the ground end GND. A first end of the feedback resistor Rf may be electrically connected to the negative phase input end of the second operational amplifier A2, a second end of the feedback resistor Rf may be electrically connected to an output end of the second operational amplifier A2, and the second operational amplifier A2 is configured to output a first reference voltage AVDD_M via the output end. The charge pump CP is configured to boost the first reference voltage AVDD_M to acquire a first boosted reference voltage VGH_M, and transmit the first boosted reference voltage VGH_M to a first input end of the level shifter LS. The first input end of the level shifter LS may be configured to receive the first boosted reference voltage VGH_M, and a second input end of the level shifter LS may be configured to receive a second reference voltage VG2. The level shifter LS is configured to generate a gate driving signal CLK_G in accordance with the first boosted reference voltage VGH_M and the second reference voltage VG2.

In FIG. 7, Q1 may be an NPN-type transistor, and Msp1, Msp2 and Msp3 may be NMOS FETs. However, the types of Q1, Msp1, Msp2 and Msp3 will not be particularly defined herein.

During the operation of the gate driving signal providing module in FIG. 7, Msp1 and Msp2 may be turned on under the control of Ctrl, so as to enable a first current I1 to flow from the drain electrode of Msp2 to the source electrode of Msp2, output VCC to the base of Q1 and turn on Q1 in a saturation state. The base-to-emitter voltage Vbe of Q1 in the saturation state has a negative temperature coefficient, and A1, which has a virtual short-circuit connection property, is in a deep negative feedback state, so it is able to accurately sense changes in the base-to-emitter voltage Vbe of Q1 and in the voltage at the first end of R1. Once Vbe is not equal to the voltage at the first end of R1 (the voltage at the first end of R1 is equal to I1*Rz1, where Rz1 represents a resistance of R1), a voltage applied to the gate electrode of Msp2 may be adjusted, so as to change I1 until Vbe is equal to I1*Rz1, i.e., the temperature-adaptive voltage from Vout is equal to Vbe. Vbe increases along with a decrease in the ambient temperature of Q1 and decreases along with an increase in the ambient temperature of Q1, so the temperature-adaptive voltage may also increase along with a decrease in the ambient temperature of Q1 and decrease along with an increase in the ambient temperature of Q1.

In addition, because Msp2, R1, Msp3 and R2 together form a current mirror, a second current I2 flowing from the drain electrode of Msp3 to the source electrode of Msp3 may be equal to K*I1, where K represents a ratio of a width-to-length ratio of a channel of Msp3 to a width-to-length ratio of a channel of Msp2. At this time, $V_{TM}$=(K*Vbe*Rz2)/Rz1, where Rz2 represents a resistance of R2. Vbe is a voltage negatively relevant to the ambient temperature, so $V_{TM}$ may also be negatively relevant to the ambient temperature.

The second operational amplifier A2, as the adder amplifier, may perform a summation operation on $V_{TM}$ and AVDD1 so as to acquire AVDD_M, the charge pump CP may boost AVDD_M to acquire VGH_M, and then the level shifter LS may generate the gate driving signal in accordance with VGH_M and VG2. AVDD_M=AVDD1*Rfz/R4z+$V_{TM}$*Rfz/R5z, where Rfz represents a resistance of Rf, R4z represents a resistance of R4, and R5z represents a resistance of R5. In addition, AVDD)_M=AVDD1*Rfz/R4z+(K*Vbe*Rz2)/Rz1*Rfz/R5z, and VGH_M=2AVDD_M+V0 (where V0 represents a constant voltage), so VGH_M=2(AVDD1*Rfz/R4z+(K*Vbe*Rz2)/Rz1*Rfz/R5z)+V0. Hence, VGH_M may be negatively relevant to the ambient temperature, i.e., it may decrease along with an increase in the ambient temperature and increase along with a decrease in the ambient temperature. Through the appropriate adjustment of values of K, R1z, R2z, R4z and Rfz, it is able to prevent a display product from not working at a low temperature and reduce the power consumption for a GOA circuit at a high temperature.

In FIG. 7, ADD1 represents a first voltage, and ADD2 represents a second voltage.

FIG. 7 shows a row of pixel units of a pixel circuit 70, where M1 represents a first TFT of a pixel unit in a first column, $C_{gd}$ represents a parasitic capacitor between a gate electrode and a drain electrode of M1, $C_{gs}$ represents a parasitic capacitor between the gate electrode and a source electrode of M1, Cs1 represents a first capacitor, Clc1 represents a first liquid crystal capacitor, Cs2 represents a second capacitor, Clc2 represents a second liquid crystal capacitor, M2 represents a second TFT of a pixel unit in a second column, MN represents an $N^{th}$ TFT of a pixel unit in an $N^{th}$ column, N is an integer greater than 2, $V_{d1}$ represents a first drain electrode voltage, $V_{s1}$ represents a first source electrode voltage, $V_{d2}$ represents a second rain electrode voltage, $V_{s2}$ represents a second source electrode voltage, $V_{dN}$ represents an $N^{th}$ drain electrode voltage, and $V_{sN}$ represents an $N^{th}$ source electrode voltage, and Vcom represents a common electrode voltage.

The ambient temperature of the TFT-LCD may be T, which is greater than or equal to a lowest temperature T0 and smaller than or equal to a highest temperature T1. When the TFT-LCD operates at T0, the temperature-adaptive adjustable voltage may be $V_{TM}$_T0, the first boosted reference voltage may be VGH_M_T0; when TFT-LCD operates at T1, the temperature-adaptive adjustable voltage may be $V_{TM}$_T1, and the first boosted reference voltage may be VGH_M_T1, where $V_{TM}$_T0>$V_{TM}$_T1, AVDD_M_T0>AVDD_M_T1 and VGH_M_T0>VGH_M_T1. Each of the temperature-adaptive adjustable voltage and the first boosted reference voltage may decrease along with an increase in the ambient temperature. At a low temperature, the first boosted reference voltage may be relatively high, and at a high temperature, the first boosted reference voltage may be relatively low. Through the appropriate adjustment of the values of K, R1z, R2z, R4z and Rfz, it is able to adjust the first boosted reference voltage to an optimum value within an operating temperature range, thereby to achieve the adaptive adjustment of the temperature within the operating temperature range, prevent the TFT-LCD from being not working at the low temperature, and reduce the power consumption for the GOA circuit at the high temperature.

The present disclosure further provides in some embodiments a display panel including the above-mentioned gate driving signal providing module.

The display panel may be any product or member having a display function, e.g., mobile phone, flat-panel computer, television, display, laptop computer, digital photo frame or navigator.

The present disclosure further provides in some embodiments a gate driving signal compensation method for use in a display panel and for compensating a gate driving signal through the above-mentioned gate driving signal providing module. The gate driving signal compensation method includes: generating, by a reference voltage generation circuit, a first reference voltage related to an ambient temperature of the display panel in accordance with a standard voltage and a temperature-adaptive voltage from a voltage providing circuit, the first reference voltage decreasing along with an increase in the ambient temperature and increasing along with a decrease in the ambient temperature; and generating, by the gate driving signal generation circuit, the gate driving signal in accordance with the first reference voltage and a second reference voltage.

In actual use, the first reference voltage may be a high voltage and the second reference voltage may be a low voltage. When the display panel operates at a low ambient temperature, the carrier mobility of each TFT of the display panel may decrease, and the GOA circuit may be charged insufficiently, so the display panel may be not working at the low temperature. When the display panel operates at a high ambient temperature, the carrier mobility of each TFT may increase, and an actual requirement on a high voltage to make the display panel in a normal and stable operation state may be reduced. At this time, through reducing the value of the high voltage, it is able to reduce the power consumption for the GOA circuit, thereby to reduce the power consumption for the logic circuit of the display panel.

According to the gate driving signal compensation method in the embodiments of the present disclosure, it is able to prevent the display panel from being not working at the low temperature, and reduce the power consumption for the GOA circuit of the display panel at the high temperature.

The above embodiments are for illustrative purposes only, but the present disclosure is not limited thereto. Obviously, a person skilled in the art may make further modifications and improvements without departing from the spirit of the present disclosure, and these modifications and improvements shall also fall within the scope of the present disclosure.

What is claimed is:

1. A voltage providing circuit, comprising a first voltage output end, a temperature-sensitive element, a power supply circuit and an output circuit, wherein:

the power supply circuit is electrically connected to a control end of the temperature-sensitive element and configured to provide a control voltage signal to the control end of the temperature-sensitive element;

the temperature-sensitive element is configured to, under control of the control voltage signal, generate a temperature-related voltage, and output the temperature-related voltage via a first end of the temperature-sensitive element, wherein a value of the temperature-related voltage changes along with an ambient temperature of the temperature-sensitive element;

the output circuit is electrically connected to the first end of the temperature-sensitive element and the first voltage output end, and configured to generate a temperature-adaptive voltage based on the temperature-related voltage, and output the temperature-adaptive voltage to the first voltage output end;

a difference between a value of the temperature-adaptive voltage and the value of the temperature-related voltage is within a predetermined range;

the output circuit includes a first operational amplifier, a second control transistor and a first control resistor;

a positive phase input end of the first operational amplifier is electrically connected to the first end of the temperature-sensitive element, a negative phase input end of the first operational amplifier is electrically connected to the first voltage output end, and an output end of the first operational amplifier is electrically connected to the control node;

a control electrode of the second control transistor is electrically connected to the control node, a first electrode of the second control transistor is electrically connected to a power source voltage end, and a second electrode of the second control transistor is electrically connected to the negative phase input end of the first operational amplifier; and a first end of the first control resistor is electrically connected to the second electrode of the second control transistor, and a second end of the first control resistor is electrically connected to the first voltage end.

2. The voltage providing circuit according to claim 1, further comprising a voltage conversion circuit including a second voltage output end, wherein the voltage conversion circuit is electrically connected to the first voltage output end, and configured to convert the temperature-adaptive voltage into a temperature-adaptive adjustable voltage, and output the temperature-adaptive adjustable voltage via the second voltage output end.

3. The voltage providing circuit according to claim 1, wherein the temperature-sensitive element is a transistor, a base of the transistor is the control end of the temperature-sensitive element, a first electrode of the transistor is the first end of the temperature-sensitive element, and a second electrode of the transistor is electrically connected to a first voltage end, wherein the base of the transistor is electrically connected to the first electrode of the transistor.

4. The voltage providing circuit according to claim 1, wherein the power supply circuit includes a first control transistor, a control electrode of the first control transistor is electrically connected to a control node, a first electrode of the first control transistor is electrically connected to a power source voltage end, and a second electrode of the first control transistor is electrically connected to the control end of the temperature-sensitive element.

5. The voltage providing circuit according to claim 2, wherein the voltage conversion circuit includes a third control transistor and a second control resistor, and wherein:

a control electrode of the third control transistor is electrically connected to the control node, a first electrode of the third control transistor is electrically connected to the power source voltage end, and a second electrode of the third control transistor is electrically connected to the second voltage output end; and a first end of the second control resistor is electrically connected to the second voltage output end, and a second end of the second control resistor is electrically connected to the first voltage end.

6. The voltage providing circuit according to claim 2, wherein the temperature-sensitive element is a transistor, a base of the transistor is the control end of the temperature-sensitive element, a first electrode of the transistor is the first end of the temperature-sensitive element, and a second electrode of the transistor is electrically connected to a first voltage end, wherein the base of the transistor is electrically connected to the first electrode of the transistor.

7. The voltage providing circuit according to claim 2, wherein the power supply circuit includes a first control transistor, a control electrode of the first control transistor is electrically connected to a control node, a first electrode of the first control transistor is electrically connected to a power source voltage end, and a second electrode of the first control transistor is electrically connected to the control end of the temperature-sensitive element.

8. The voltage providing circuit according to claim 2, wherein the output circuit includes a first operational amplifier, a second control transistor and a first control resistor, and wherein:

a positive phase input end of the first operational amplifier is electrically connected to the first end of the temperature-sensitive element, a negative phase input end of the first operational amplifier is electrically connected to the first voltage output end, and an output end of the first operational amplifier is electrically connected to the control node;

a control electrode of the second control transistor is electrically connected to the control node, a first electrode of the second control transistor is electrically connected to the power source voltage end, and a second electrode of the second control transistor is electrically connected to the negative phase input end of the first operational amplifier; and a first end of the first control resistor is electrically connected to the second electrode of the second control transistor, and a second end of the first control resistor is electrically connected to the first voltage end.

9. A gate driving signal providing module, comprising a voltage providing circuit, a reference voltage generation circuit and a gate driving signal generation circuit, wherein:

the voltage providing circuit comprises a first voltage output end, a temperature-sensitive element, a power supply circuit and an output circuit;

the power supply circuit is electrically connected to a control end of the temperature-sensitive element and configured to provide a control voltage signal to the control end of the temperature-sensitive element;

the temperature-sensitive element is configured to, under the control of the control voltage signal, generate a temperature-related voltage, and output the temperature-related voltage via a first end of the temperature-sensitive element, and a value of the temperature-related voltage changes along with an ambient temperature of the temperature-sensitive element;

the output circuit is electrically connected to the first end of the temperature-sensitive element and the first voltage output end, and configured to generate a temperature-adaptive voltage based on the temperature-related voltage, and output the temperature-adaptive voltage to the first voltage output end;

a difference between a value of the temperature-adaptive voltage and the value of the temperature-related voltage is within a predetermined range;

the reference voltage generation circuit is electrically connected to the first voltage output end of the voltage providing circuit, and configured to generate a first reference voltage based on a standard voltage and the temperature-adaptive voltage from the first voltage output end, and output the first reference voltage via a reference voltage output end;

a first input end of the gate driving signal generation circuit is electrically connected to the reference voltage output end, and a second input end of the gate driving signal generation circuit is configured to receive a second reference voltage; and the gate driving signal generation circuit is configured to generate a gate driving signal based on the first reference voltage and the second reference voltage, and output the gate driving signal via the gate driving signal output end.

10. The gate driving signal providing module according to claim 9, wherein the voltage providing circuit further includes a voltage conversion circuit including a second voltage output end, and wherein:

the voltage conversion circuit is electrically connected to the first voltage output end, and configured to convert the temperature-adaptive voltage into a temperature-adaptive adjustable voltage, and output the temperature-adaptive adjustable voltage via the second voltage output end; and the reference voltage generation circuit is electrically connected to the second voltage output end, and configured to perform a weighted summation operation on the temperature-adaptive adjustable voltage and the standard voltage to generate the first reference voltage, and output the first reference voltage via the reference voltage output end.

11. The gate driving signal providing module according to claim 10, wherein the reference voltage generation circuit includes a first input resistor, a second input resistor, a third input resistor, a feedback resistor, and a second operational amplifier as an adder amplifier, and wherein:

a first end of the first input resistor is electrically connected to a positive phase input end of the second operational amplifier, and a second end of the first input resistor is configured to receive the standard voltage;

a first end of the second input resistor is electrically connected to the positive phase input end of the second operational amplifier, and a second end of the second input resistor is configured to receive the temperature-adaptive adjustable voltage;

a first end of the third input resistor is electrically connected to a negative phase input end of the second operational amplifier, and a second end of the third input resistor is electrically connected to the second voltage end; and a first end of the feedback resistor is electrically connected to the negative phase input end of the second operational amplifier, a second end of the feedback resistor is electrically connected to an output end of the second operational amplifier, and the second operational amplifier is configured to output the first reference voltage via the output end of the second operational amplifier.

12. The gate driving signal providing module according to claim 9, further comprising a booster circuit, wherein:

the first input end of the gate driving signal generation circuit is connected to the reference voltage output end through the booster circuit;

the booster circuit is configured to boost the first reference voltage to acquire a first boosted reference voltage, and transmit the first boosted reference voltage to the first input end of the gate driving signal generation circuit; and the gate driving signal generation circuit is configured to generate the gate driving signal based on the first boosted reference voltage and the second reference voltage.

13. The gate driving signal providing module according to claim 9, wherein the gate driving signal generation circuit is a level shifter.

14. The gate driving signal providing module according to claim 12, wherein the booster circuit is a charge pump.

15. A gate driving signal compensation method for use in a display panel and for compensating a gate driving signal through the gate driving signal providing module according to claim 9, comprising:

generating, by a reference voltage generation circuit, a first reference voltage related to an ambient temperature of the display panel based on a standard voltage and a temperature-adaptive voltage from a voltage providing circuit, the first reference voltage decreasing along with an increase in the ambient temperature and increasing along with a decrease in the ambient temperature; and generating, by the gate driving signal generation circuit, the gate driving signal based on the first reference voltage and a second reference voltage.

16. The gate driving signal compensation method according to claim 15, wherein the first reference voltage is a high voltage, and the second reference voltage is a low voltage.

17. A display panel, comprising the gate driving signal providing module according to claim 9.

18. A voltage providing circuit, comprising a first voltage output end, a temperature-sensitive element, a power supply circuit and an output circuit, wherein:

the power supply circuit is electrically connected to a control end of the temperature-sensitive element and configured to provide a control voltage signal to the control end of the temperature-sensitive element;

the temperature-sensitive element is configured to, under the control of the control voltage signal, generate a temperature-related voltage, and output the temperature-related voltage via a first end of the temperature-sensitive element, and a value of the temperature-related voltage changes along with an ambient temperature of the temperature-sensitive element;

the output circuit is electrically connected to the first end of the temperature-sensitive element and the first voltage output end, and configured to generate a temperature-adaptive voltage based on the temperature-related voltage, and output the temperature-adaptive voltage to the first voltage output end;

a difference between a value of the temperature-adaptive voltage and the value of the temperature-related voltage is within a predetermined range;

the voltage providing circuit further comprises a voltage conversion circuit including a second voltage output end, wherein the voltage conversion circuit is electrically connected to the first voltage output end, and configured to convert the temperature-adaptive voltage into a temperature-adaptive adjustable voltage, and output the temperature-adaptive adjustable voltage via the second voltage output end;

the voltage conversion circuit includes a third control transistor and a second control resistor;

a control electrode of the third control transistor is electrically connected to the control node, a first electrode of the third control transistor is electrically connected to a power source voltage end, and a second electrode of the third control transistor is electrically connected to the second voltage output end; and a first end of the second control resistor is electrically connected to the second voltage output end, and a second end of the second control resistor is electrically connected to the first voltage end.

* * * * *